US008245586B2

(12) United States Patent
Panzer et al.

(10) Patent No.: US 8,245,586 B2
(45) Date of Patent: Aug. 21, 2012

(54) PIPETTING APPARATUS FOR ASPIRATION AND DISPENSATION OF A METERING FLUID

(75) Inventors: Armin Panzer, Trin (CH); Patrick Schelling, Chur (CH)

(73) Assignee: Hamilton Bonaduz AG, Bonaduz (CH)

( * ) Notice: Subject to any disclaimer, the term of this patent is extended or adjusted under 35 U.S.C. 154(b) by 644 days.

(21) Appl. No.: 12/435,772

(22) Filed: May 5, 2009

(65) Prior Publication Data

US 2009/0277285 A1 Nov. 12, 2009

(30) Foreign Application Priority Data

May 6, 2008 (EP) ..... 08008525

(51) Int. Cl.
*B01L 3/02* (2006.01)

(52) U.S. Cl. ..... 73/864.17; 73/863.32; 73/864.22

(58) Field of Classification Search .. 73/864.13–864.17, 73/864.22, 864.24, 863.32; 422/927
See application file for complete search history.

(56) References Cited

U.S. PATENT DOCUMENTS

| | | | | |
|---|---|---|---|---|
| 4,563,907 | A * | 1/1986 | Johnson et al. | 73/864.16 |
| 4,599,220 | A * | 7/1986 | Yonkers et al. | 73/864.17 X |
| 4,741,737 | A | 5/1988 | Meyer et al. | |
| 4,809,711 | A | 3/1989 | Meyer et al. | |
| 6,471,670 | B1 | 10/2002 | Enrenfels et al. | |
| 6,938,504 | B2 * | 9/2005 | Camenisch | 73/864.01 |
| 8,011,257 | B2 * | 9/2011 | Kneucker et al. | 73/864.17 |
| 2004/0211247 | A1 * | 10/2004 | Hajduk et al. | 73/54.07 |
| 2005/0006410 | A1 * | 1/2005 | Bach et al. | 222/309 |
| 2007/0025882 | A1 * | 2/2007 | Zuppiger et al. | 422/100 |
| 2007/0108235 | A1 | 5/2007 | Sogaro | |

FOREIGN PATENT DOCUMENTS

| | | | | |
|---|---|---|---|---|
| DE | 3432992 | A1 * | 3/1985 | 73/864.14 |
| GB | 2 426 293 | A | 11/2006 | |
| GB | 2429199 | A | 2/2007 | |
| JP | 52103684 | U | 8/1977 | |
| JP | 52110484 | U | 8/1977 | |
| JP | 11023583 | A | 1/1999 | |
| JP | 2004061397 | A | 2/2004 | |
| JP | 2004108884 | A | 4/2004 | |

OTHER PUBLICATIONS

European search report for priority application EP 08 008 525.1 mailed Oct. 8, 2008 (in German).

* cited by examiner

*Primary Examiner* — Thomas P Noland
(74) *Attorney, Agent, or Firm* — Rothwell, Figg, Ernst & Manbeck, P.C.

(57) ABSTRACT

For aspiration and dispensation of a metering fluid, a pipetting apparatus comprises a work fluid which differs from the former, the work fluid being accommodated in a work space with a variable volume which extends along a channel axis and, with reference to the latter, is formed by a piston-cylinder system at least along an axial section of the channel axis, having a cylinder which delimits the work space along a cylinder section in the radial direction and a piston which delimits the work space in a first axial direction, the cylinder and the piston being arranged so that they can move with respect to each other such that the piston-cylinder system has an axial longitudinal end region for metering, which is open for aspiration and dispensation, and an axial longitudinal end region for work which is closed by the piston, the piston being designed as an outer piston and surrounding the cylinder on the outside in the longitudinal end region for work of the piston-cylinder system.

19 Claims, 2 Drawing Sheets

PIPETTING APPARATUS FOR ASPIRATION AND DISPENSATION OF A METERING FLUID

Figure 1:
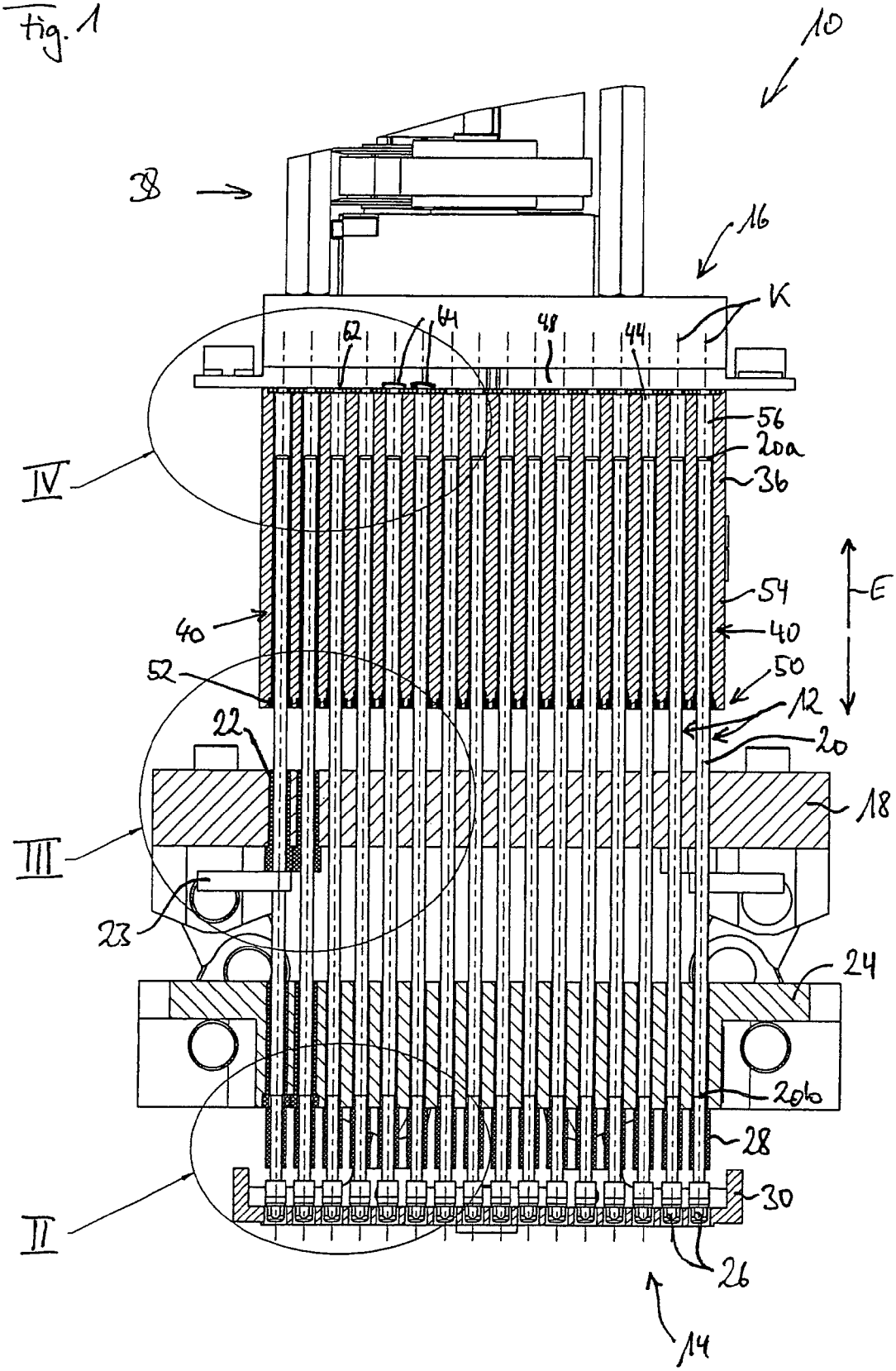

The present invention relates to a pipetting apparatus for aspiration and dispensation of a metering fluid with the aid of a work fluid which differs from the former, the work fluid being accommodated in a work space with a variable volume which extends along a channel axis and, with reference to the latter, is formed by a piston-cylinder system at least along an axial section of the channel axis, having a cylinder which delimits the work space along a cylinder section in the radial direction and a piston which delimits the work space in a first axial direction, the cylinder and the piston being arranged so that they can move with respect to each other such that the piston-cylinder system has an axial longitudinal end region for metering, which is open for aspiration and dispensation, and an axial longitudinal end region for work which is closed by the piston.

By way of example, such pipetting apparatuses are known from EP-A-1 745 851 or EP-A-1 412 759. These documents also disclose measuring the pressure of the work fluid in order to be able to draw conclusions therefrom about the proper work flow of an aspiration or/and dispensation carried out.

Pipetting apparatuses of the type mentioned initially are used for very precise metering of fluids, in particular liquids, in laboratories and in industry.

The amount of metered fluid that can be accommodated, that is to say aspirated, is in this case limited by the largest possible volume change of the work space in the pipetting apparatus.

Since use is generally made of pipetting apparatuses which have a number of so-called "pipette channels", which each have a work space and are arranged in rows and columns like a matrix, the components forming a pipette channel are miniaturized, resulting not only in work spaces which have a small volume in absolute terms, but also in the relative motion of piston and cylinder of the piston-cylinder system only allowing a small change in work volume, and this sets an upper bound on the volume of metering fluid to be aspirated and dispensed.

The pressure sensors from the prior art disclosed in the abovementioned documents are provided on each pipette channel, generally laterally, and additionally require installation space which is taken from the piston-cylinder system and further decreases the largest possible change of the work volume.

It is therefore the object of the present invention to develop a pipetting apparatus of the type mentioned initially which makes it possible to accommodate more metering fluid than the prior art previously made possible, but where the relative motion range between piston and cylinder is essentially the same.

This object is achieved by a generic pipetting apparatus in which the piston is designed as an outer piston and surrounds the cylinder on the outside in the longitudinal end region for work of the piston-cylinder system.

There is a larger change in the volume of the work space, which is also delimited by the involvement of the piston, under the same lift if the piston is designed as outer piston than if the piston were an inner piston, as known from the prior art, which is guided in the interior of the cylinder on the inner wall of the cylinder. The difference in the work volume change under the same lift of a pipetting apparatus according to the present invention compared to the prior art in this case corresponds to the volume of the cross-sectional area of the cylinder wall multiplied by the lift.

If the statement that the work space is formed by a piston-cylinder system at least along an axial section of the work space is made in the present application, this is only intended to show that a piston-cylinder system contributes to the formation of the work space. It is possible for pipette tips or the like to be able to be coupled to the piston-cylinder system, as known from the prior art; these tips also contribute to the volume of the work space if they are coupled on.

Starting from the interior of the piston-cylinder system, the piston-cylinder system is delimited in the first axial direction by the piston and is open in a second axial direction, which is counter to the first direction, so that in this second direction a change in pressure of the work fluid, effected by an increase or decrease of the work space, can act on the metering fluid and thus guide the latter into or out of the work space.

The mentioned channel axis is generally a linear channel axis. However, the possibility of the channel axis having a curved profile, should this be required for specific applications, should not be excluded.

"Cylinder section" designates the axial section of the pipette channel along which the cylinder extends.

The seal required for the work space to function can be effected between piston and cylinder by virtue of the fact that a radially inner surface of the piston lies opposite a radially outer surface of the cylinder in a cylinder end region for work in the vicinity of the longitudinal end region for work of the piston-cylinder system, with a seal being provided on at least one of the two surfaces, which butts against the respective other surface, in order to seal the piston and the cylinder against one another and hence seal the work space from the surroundings.

In order to accommodate the cylinder in the outer piston, it is possible for the piston to have a hollow which, with respect to the channel axis and when observed in the assembled state, is delimited in the radial direction by a piston skirt running about the channel axis and in the first axial direction by a piston head, and which is open in a second axial direction which is counter to the first axial direction.

This leads to a piston with a pot-shaped hollow, with the piston skirt advantageously being designed to be cylindrical for reasons of particularly simple manufacturing. However, this should not exclude the possibility that the piston, if it is produced by an injection-moulding process, can be provided with mould-release bevelling such that the piston skirt tapers or is enlarged from its open longitudinal end to the piston head.

In order to be able to implement the largest possible piston lift, it is advantageous to arrange the abovementioned seal for sealing the piston and cylinder with respect to one another in the longitudinal end region of the piston skirt which is remote from the piston head or/and in the cylinder end region for work of the cylinder.

The piston-cylinder system can then easily be designed having an outer piston if the cylinder end region for work is accommodated in the hollow of the piston in such a way that the piston and cylinder can undergo relative motion with respect to one another.

Here, reference is explicitly made to the fact that it is unimportant to the functioning of the pipetting apparatus according to the invention whether the piston is provided fixed to the frame and the cylinder is provided moveably on the pipetting apparatus or vice versa, or even if both piston and cylinder are arranged such that they are moveable relative to a fixed frame of the pipetting apparatus.

As already indicated above in the context of the prior art, measuring the pressure of the work fluid in the work space is known in order to draw conclusions about the quality of a metering process.

In the prior art, a pressure sensor of this type is generally coupled onto the work space via a lateral opening in the cylinder wall.

Furthermore, the pressure is only a preferred state variable of the work fluid which can be acquired particularly easily and which is significant with respect to the quality of a metering process.

Furthermore, it is advantageous for the pipetting apparatus if the sensor is provided at the largest possible distance from the actual location of the intake of the work fluid in the work space in order to avoid, as far as possible, interaction between the sensor and the metering fluid, in particular cross-contamination or a functional fault of sensor. It is for this reason that, for the purposes of quality monitoring of a metering process using a pipetting apparatus according to a development of the present invention, accommodating a sensor on the piston is considered; the sensor being designed to acquire at least one state variable of the work fluid, preferably the pressure thereof.

For example, the temperature or/and the density of the work fluid could be acquired as different or additional state variables.

As already mentioned above, the outer piston of the pipetting apparatus according to the invention is designed with a hollow so that in order to attach the sensor to the piston, provision can be made for a piston wall, which delimits the hollow, to have an opening at which the sensor for acquiring the state variable is provided.

A particularly functionally-reliable and space-saving option for attaching the sensor to the piston consists in closing off the opening in the piston wall using the sensor. Particular preference is given to the sensor forming part of a piston wall which delimits the hollow of the piston because this saves a considerable amount of space. This should not only cover the case where the sensor forms an integral part of the piston wall, but also the case in which the sensor is attached directly to the piston for closing the opening, if need be by means of a substrate or the like.

In a particularly simple and space-saving fashion, the sensor can be arranged in the region of the piston head, in particular it can form part of the latter. To this end, provision can be made in the design for the piston to be made from at least two parts, with a casing part with at least one through-hole and with a cover part which is connected to the casing part in such a fashion that it closes off the at least one through-hole on one side. With respect to the channel axis, the casing part then forms a radial wall of the piston-cylinder system formed using the piston, while the cover part forms a boundary surface of the piston pointing in the axial direction.

In very general terms, the sensor can be arranged in a space-saving fashion such that the virtual channel axis passes through it.

In this case, at least one sensor for acquiring a state variable of the work fluid can be provided on the cover part. Preferably, the sensor is arranged at a point which is axially aligned with the through-hole in the casing part in the assembled state of the pipetting apparatus, that is to say it is located radially within a delimiting wall of the casing part for delimiting the through-hole in an end region in the vicinity of the cover part. Such a combination of casing part and cover part makes it possible to also form outer pistons which are suitable for multiple-pipette heads such that a multiplicity of outer pistons can be formed from one casing part and one cover part.

In order to increase the effectiveness of the pipetting apparatus described here, it is possible for the former to have a pipette head with a multiplicity of work spaces which are preferably arranged like a matrix. Such a matrix is preferably a matrix designed with rows and columns which are arranged orthogonally with respect to one another. The individual work spaces are in general designed separately from one another.

In this case, quality control of the metering processes is possible in a particularly easy and thorough manner if a sensor for acquiring a state variable of the work fluid is assigned to each work space.

As already indicated above, the casing part for forming a multiplicity of outer pistons can be designed as a perforated plate. In the process, the thickness of the perforated plate can be geared to the desired lift of the outer piston so that the thickness of the casing part corresponds to at least the desired lift of the outer piston, if necessary adding on safety distances for seals and for avoiding collisions.

It is then possible for a multiplicity of state variable sensors to be arranged on the cover part and these sensors are preferably also arranged like a matrix; to be precise their arrangement corresponds to the provided arrangement of outer pistons. It is particularly simple to arrange the state variable sensors on the surface of an end face of the cover part, although the possibility of the cover part having hollows or even through-holes in which the state variable sensors are accommodated should not be excluded.

Lines connect the at least one state variable sensor to a control or/and computational unit which processes signals supplied by the state variable sensor.

Figures 2, 3, 4:
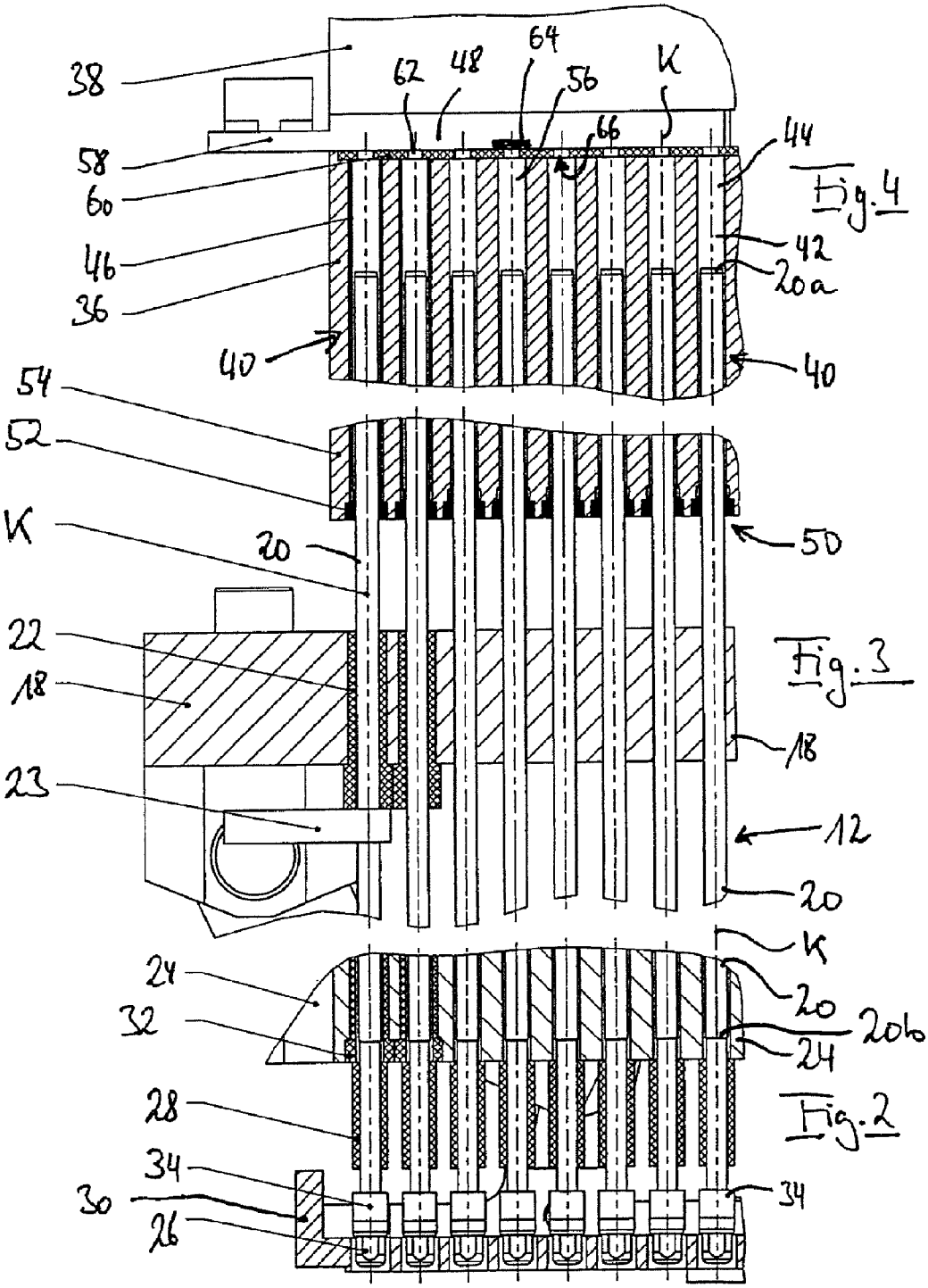

The present invention will be explained in more detail below with reference to the attached drawings, in which FIG. 1 shows a longitudinal section through an essential part of a pipetting apparatus according to the invention, FIG. 2 shows an enlarged section of region II of the pipetting apparatus in accordance with FIG. 1, FIG. 3 shows an enlarged section of region III of the pipetting apparatus in accordance with FIG. 1, and FIG. 4 shows an enlarged section of region IV of the pipetting apparatus in accordance with FIG. 1.

An essential section of a pipetting apparatus according to the invention is generally designated by 10 in FIG. 1. It is a multiple-pipette head with 384 pipette channels 12 which are arranged in an orthogonal matrix of 16×24 pipette channels 12.

Each pipette channel 12 runs along a channel axis K from a metering-side longitudinal end 14 of the pipetting apparatus 10 to a work-side longitudinal end 16 of the said apparatus.

Starting point for the description of the pipetting apparatus 10 according to the invention is a central carrier plate 18, which is fixed to the frame and on which metallic cylinders 20 are accommodated by means of insulation elements 22 made of an electrically insulating elastomer. The cylinders 20 are designed as hollow cylinders and are thus accommodated on the carrier plate 18 in a stationary manner, i.e. they are fixed to the frame. The electrically insulating insulation elements 22 are used to insulate the electrically conductive cylinders 20 from the likewise electrically conductive carrier plate 18 and so a capacitive liquid level detection (cLLD) is independently possible for each pipette channel 12.

For the purposes of this capacitive liquid level detection, the pipette channels 12 are connected to a signal line connection 23, only one of which is illustrated for the sake of simplicity.

In FIG. 1, a compression plate 24, which allows the coupling of pipette tips not illustrated in FIGS. 1 to 4 to the coupling ends 26 of the pipetting apparatus 10 in a known manner, is located below the carrier plate 18 which is fixed to the frame and it can move relative to said carrier plate 18 along the channel axes K.

A stripping-off plate 30, which can move along the channel axes K relative to the carrier plate 18, ensures safe discarding of pipette tips from the coupling ends 26 of the pipette channels 12 and thus ensures a decoupling of pipette tips from the multiple-pipette head illustrated in FIG. 1.

The cylinders 20 are, like in the carrier plate 18, also surrounded by an elastomeric insulation element 32 in the compression plate 24 for electrical insulation therefrom. However, in contrast to the carrier plate 18, the insulation elements 32 in the compression plate 24 are arranged with radial spacing from the cylinders 20 so as not to hinder relative motion of the compression plate 24 relative to the cylinders 20.

The pipette channels 12 each have a compression ring 34 in the vicinity of the coupling ends 26, which ring is axially compressed by axial motion of the compression plate 24, downwards in FIGS. 1 and 2, whilst imparting the compression casings 28, and hence it is radially stretched on account of its transverse contraction properties such that a pipette tip can be held by friction or/and force at the coupling end 26 of the pipette channels 12, depending on the design of the negative coupling geometry of the pipette tip which geometry surrounds the compression ring 34 radially on the outside in the coupled state.

FIG. 1 shows that a metering plate 36 is provided in FIG. 1 above the carrier plate 18 and can be moved relative to the latter along the channel axes K. This metering plate 36, which can be driven to move relative to the carrier plate 18 in the direction of the channel axes K by means of a movement drive mechanism 38 which is only illustrated in part, forms a multiplicity of outer pistons 40 which surround, radially and axially on the outside, a cylinder longitudinal end for work 20*a* of the cylinders 20.

The outer pistons 40 formed by the metering plate 36 have a hollow 42 in which the region of the cylinder longitudinal end for work 20*a* of the cylinders 20 is accommodated.

Hence, every pipette channel 12 comprises a work space 44 which is defined by the volume of the hollow 42 of the pistons 40 filled with work fluid and the interior volume in the hollow space of the cylinders 20 (not illustrated in FIGS. 1 to 4) and which thus extends at least up to the cylinder longitudinal end for metering 20*b* of the cylinders 20. In actual fact, the work space still extends up to the axial longitudinal ends of the pipette channels 12, that is to say up to the openings of the coupling ends 26 and, in the case of coupled-on pipette tips, even into the pipette tips from there.

However, the section of the work spaces 44 surrounded by the pistons 40 and the cylinders 20 is of particular interest to the present invention.

The cylindrical inner wall of the pistons 40 is formed by a cylindrical insulation element 46 so that the pistons and cylinders are electrically insulated with respect to one another.

In the example shown in FIGS. 1 to 4, provision is made of a seal 52, which runs about the cylinder 20 and butts in a sealing manner against the outer wall of the cylinder 20, in each piston 40 on that longitudinal end 50 of the pistons 40 which is remote from the piston head 48, and which seal seals the work space 44 between the pistons 40 and the cylinders 20 from the external surroundings.

In the present example, the metering plate 36 is formed from a number of parts, namely by a casing part 54 which comprises a multiplicity of through-holes 56 and thus is designed as a perforated plate with a predetermined thickness.

Using the working space 44 as a starting point, the casing part 54 is closed off by a cover part 58 in a first direction E, with provision being made of a sealing mat 60 with through-holes 62 to seal the work space 44 at the contact point between cover part 58 and casing part 56.

Assigned to each through-bore 56 of the casing part 54, a pressure sensor 64 is arranged in the cover part 58 for each pipette channel 12. These pressure sensors 64, of which only one is illustrated in FIG. 4, close off the through-holes 62 of the sealing mat 60 and thus form part of the piston head 66.

The pressure sensors 64 are connected to a computational unit for evaluating the signals provided by the pressure sensors 64 via signal lines which are not illustrated.

The invention claimed is:

1. A pipetting apparatus for aspiration and dispensation of a metering fluid with the aid of a work fluid that differs from the metering fluid, the work fluid being accommodated in a work space with a variable volume that extends along a channel axis and is formed by a piston-cylinder system at least along an axial section of the channel axis, the piston-cylinder system having a cylinder that delimits the work space along a cylinder section in the radial direction and a piston that delimits the work space in a first axial direction, the cylinder and the piston being arranged so that the piston and the cylinder are capable of moving with respect to each other such that the piston-cylinder system has an axial longitudinal end region for metering, which is open for aspiration and dispensation, and an axial longitudinal end region for work which is closed by the piston, the piston being an outer piston that surrounds the cylinder on the outside in the axial longitudinal end region for work of the piston-cylinder system, wherein the piston accommodates a sensor that is configured to acquire at least one state variable of the work fluid.

2. The pipetting apparatus of claim 1, wherein a radially inner surface of the piston lies opposite a radially outer surface of the cylinder in a cylinder end region for work in the vicinity of the longitudinal end region for work of the piston-cylinder system, with a seal being provided on at least one of the two surfaces which butts against the respective other surface in order to seal the piston and the cylinder against one another.

3. The pipetting apparatus of claim 2, wherein the piston has a hollow which, with respect to the channel axis and when observed in the assembled state, is delimited in the radial direction by a piston skirt running about the channel axis and in the first axial direction by a piston head, and which is open in a second axial direction which is counter to the first axial direction.

4. The pipetting apparatus of claim 3, wherein the cylinder end region for work is accommodated in the hollow of the piston such that the cylinder end region for work is capable of relative motion.

5. The pipetting apparatus of claim 3, wherein a piston wall delimits the hollow and has an opening at which the sensor for acquiring the state variable is provided.

6. The pipetting apparatus of claim 5, wherein the sensor closes off the opening.

7. The pipetting apparatus of claim 5, wherein the sensor is arranged in the region of the piston head or forms part of the piston head.

8. The pipetting apparatus of claim 7, wherein the piston is made from at least two parts including a casing part with at least one through-hole and a cover part which is connected to the casing part in such a fashion that the cover part closes off the at least one through-hole on one side.

9. The pipetting apparatus of claim 8, wherein at least one sensor for acquiring a state variable of the work fluid is provided on the cover part.

10. The pipetting apparatus of claim 9, wherein the at least one sensor for acquiring the state variable of the work fluid is provided on the cover part at a point which is axially aligned with the through-hole in the assembled state of the apparatus.

11. The pipetting apparatus of claim 3, wherein the sensor forms part of a piston wall which delimits the hollow of the piston.

12. The pipetting apparatus of claim 1, further comprising a pipette head with a multiplicity of work spaces.

13. The pipetting apparatus of claim 12, wherein a sensor for acquiring a state variable of the work fluid is assigned to each work space.

14. The pipetting apparatus of claim 12, wherein a radially inner surface of the piston lies opposite a radially outer surface of the cylinder in a cylinder end region for work in the vicinity of the longitudinal end region for work of the piston-cylinder system, with a seal being provided on at least one of the two surfaces which butts against the respective other surface in order to seal the piston and the cylinder against one another, the piston has a hollow which, with respect to the channel axis and when observed in the assembled state, is delimited in the radial direction by a piston skirt running about the channel axis and in the first axial direction by a piston head, and which is open in a second axial direction which is counter to the first axial direction, the piston is made from at least two parts including a casing part with at least one through-hole and a cover part which is connected to the casing part in such a fashion that the cover part closes off the at least one through-hole on one side and the casing part is a perforated plate.

15. The pipetting apparatus of claim 12, wherein radially inner surface of the piston lies opposite a radially outer surface of the cylinder in a cylinder end region for work in the vicinity of the longitudinal end region for work of the piston-cylinder system, with a seal being provided on at least one of the two surfaces which butts against the respective other surface in order to seal the piston and the cylinder against one another, the piston has a hollow which, with respect to the channel axis and when observed in the assembled state, is delimited in the radial direction by a piston skirt running about the channel axis and in the first axial direction by a piston head, and which is open in a second axial direction which is counter to the first axial direction, the piston is made from at least two parts including a casing part with at least one through-hole and a cover part which is connected to the casing part in such a fashion that the cover part closes off the at least one through-hole on one side and a multiplicity of state variable sensors are arranged on the cover part.

16. The pipetting apparatus of claim 15, wherein the multiplicity of state variable sensors are arranged like a matrix on the cover part.

17. The pipetting apparatus of claim 15, wherein the multiplicity of state variable sensors are arranged on the cover part on an end face of the cover part.

18. The pipetting apparatus of claim 12, wherein the multiplicity of work spaces are arranged like a matrix.

19. The pipetting apparatus of claim 1, wherein the at least one state variable of the work fluid comprises the pressure of the work fluid.

* * * * *